US005783037A

United States Patent [19]

Brahmbhatt

[11] Patent Number: 5,783,037

[45] Date of Patent: Jul. 21, 1998

[54] SYSTEM AND METHOD FOR OPERATING A PULP MILL

[75] Inventor: Sudhir R. Brahmbhatt, Glencoe, Mo.

[73] Assignee: MG Industries, Malvern, Pa.

[21] Appl. No.: 701,728

[22] Filed: Aug. 22, 1996

[51] Int. Cl.[6] ..... D21C 3/00

[52] U.S. Cl. ..... 162/65; 162/63; 162/237; 162/246

[58] Field of Search ..... 162/63, 65, 68, 162/57, 237, 243, 246

[56] References Cited

U.S. PATENT DOCUMENTS 3,654,070 4/1972 Pradt et al. ..... 162/30
4,274,913 6/1981 Kikuiri et al. ..... 162/65

*Primary Examiner*—Donald E. Czaja
*Assistant Examiner*—Steven B. Leavitt
*Attorney, Agent, or Firm*—William H. Eilberg

[57] ABSTRACT

A pulp mill includes a digester which contains a raw material, a digesting medium, and a source of steam. Oxygen is injected into the steam line, at a point which minimizes exposure of the oxygen to the steam outside of the digester. The oxygen can also be injected directly into the digester. The oxygen speeds the chemical reactions in the digester, allowing the digesting process to be completed with a reduced quantity of chemicals and/or steam, and at a faster rate. The present invention improves the quality of the effluents from a pulp mill, and makes it easier for the operator of the mill to comply with environmental regulations.

21 Claims, 2 Drawing Sheets

SYSTEM AND METHOD FOR OPERATING A PULP MILL

BACKGROUND OF THE INVENTION

This invention relates to the production of pulp, which is used in the manufacture of paper. The invention provides a method and system which substantially improves the efficiency of a pulp mill.

There are many processes for making pulp and paper. Most or all of these processes share the following basic elements. A typical pulp mill has a source of raw material, which may be wood chips or cotton, a digesting medium, and a digester vessel. The object of the digesting process is to separate the cellulose fibers, present in the raw material, from the matrix of lignin which holds the fibers together. This separation can be achieved by mechanical means, or by chemical treatment which dissolves the lignin. The pulp thus formed comprises fibers that can then be recemented together to form paper, in the presence of suitable chemicals.

There are many forms of chemical digesting. In one process, the raw material is cooked in a digesting medium which includes a caustic solution, i.e. NaOH, which may also include $Na_2S$ and $Na_2CO_3$. Sulfite processes use a digesting medium containing bisulfites which dissolve the lignin. The digesting medium is known as a "cooking liquor". When the digesting process is completed, the cooking liquor is known as "black liquor" which is often treated for reuse and/or converted into another product. For example, a heavy hydrocarbon oil, known as "tall oil", one byproduct of spent cooking liquor, can be refined into turpentine.

A digester may operate in a continuous manner or as a batch unit. In either case, the raw material is mixed with the digesting medium. Steam is injected into the digester to maintain pressure inside the vessel, and to provide an aqueous medium for the digesting process. When the raw material is cotton, the caustic material in the cooking liquor and the steam in the digester disintegrate the cotton without breaking its fibers. The resulting product is a pulp which is suitable for making paper.

Before making paper from the pulp resulting from the digesting process, it is usually necessary to remove chemicals from it. The process of removing chemicals from pulp is known as brown stock washing. It may also be necessary to bleach the pulp, at this stage, to control the color of the final product. The bleaching process may be performed in multiple stages, as necessary.

Caustic material in the digester may also aid in bleaching the raw material, while the digesting process is still in progress, although the main bleaching operation generally occurs after the digesting is completed.

In large paper mills, the cooking liquor used in the digesting process is recycled and re-used. But eventually, the cooking liquor can be used no longer, and some residue therefrom will emerge from the mill, and must be discharged. Similarly, in a large mill, the chemicals removed from the pulp during the brown stock washing process will also be recycled, but there is still some residue to be discharged. These residues can cause environmental harm. In a smaller mill, the chemicals may not be recycled at all, because it may not be economical to do so, and thus the discharge of chemicals from a smaller mill may pose even greater environmental risk.

Thus, the residues of the chemicals used in paper making must be properly treated before they are discharged into rivers or streams. Governmental regulations set limits on the values of BOD (biological oxygen demand), COD (chemical oxygen demand), and TSS (total suspended solids) associated with the effluent stream. Such regulations have become increasingly strict. A pulp mill operator typically faces the choice of installing a waste water treatment facility or paying a heavy fine for discharging waste water that does not comply with the required standards.

In an effort to comply with governmental regulations for waste water quality, some operators of pulp mills have attempted to use oxygen, hydrogen peroxide, ozone, and other oxidants to treat the pulp during the bleaching process. The principal components of the harmful effluents from a pulp mill are organic materials. Treating such materials with oxidants breaks them down, and converts them into harmless chemicals. But such treatment has no effect on the efficiency of the digesting process, since, by definition, the treatment occurs after the pulp has left the digester.

The present invention provides a method and system for improving the efficiency of operation of a pulp mill. In particular, the invention provides means for improving the efficiency of the digesting process. In addition to enhancing the operation of the mill, the present invention inherently tends to reduce the amount of unwanted effluent components, and therefore makes it easier to comply with regulations governing effluent treatment.

SUMMARY OF THE INVENTION

The method of the present invention includes the step of injecting oxygen into the steam line which enters the digester of a pulp mill. The oxygen is preferably injected at a location in the line immediately before the steam enters the digester. It is also possible to inject oxygen directly into the digester vessel, instead of, or in addition to, injecting it into the steam line.

The method further includes the step of injecting oxygen, with steam, into a bleaching system, following completion of the digesting process, in a manner similar to that used at the digester.

The method may also include the step of injecting oxygen into the effluent line from a brown stock washing stage.

The system of the present invention therefore includes a source of oxygen, and an oxygen supply conduit. The oxygen supply conduit is connected to the steam line of a pulp mill, the connection between the oxygen conduit and the steam line being located immediately adjacent to the point where steam enters a digester vessel. Another oxygen supply conduit may be connected directly to the interior of the vessel. Still another oxygen supply conduit may be connected to a peroxide tower which is used for bleaching the pulp. Yet another oxygen conduit may be connected to an effluent line leading from a brown stock washing stage.

The use of oxygen in the digesting process has been found to increase the efficiency of the process, not only by reducing the time necessary to produce the pulp, but also by reducing the quantity of chemicals needed to support the digesting process.

The present invention therefore has the primary object of enhancing the efficiency of operation of a pulp mill.

The invention has the further object of making it easier for pulp mill operators to comply with environmental regulations.

The invention has the further object of reducing the time required to produce pulp.

The invention has the further object of reducing the quantity of chemicals required in the process of pulp production.

The reader skilled in the art will recognize other objects and advantages of the invention, from the following brief description of the drawings, the detailed description of the invention, and the appended claims.

DETAILED DESCRIPTION OF THE INVENTION

Figure 1:
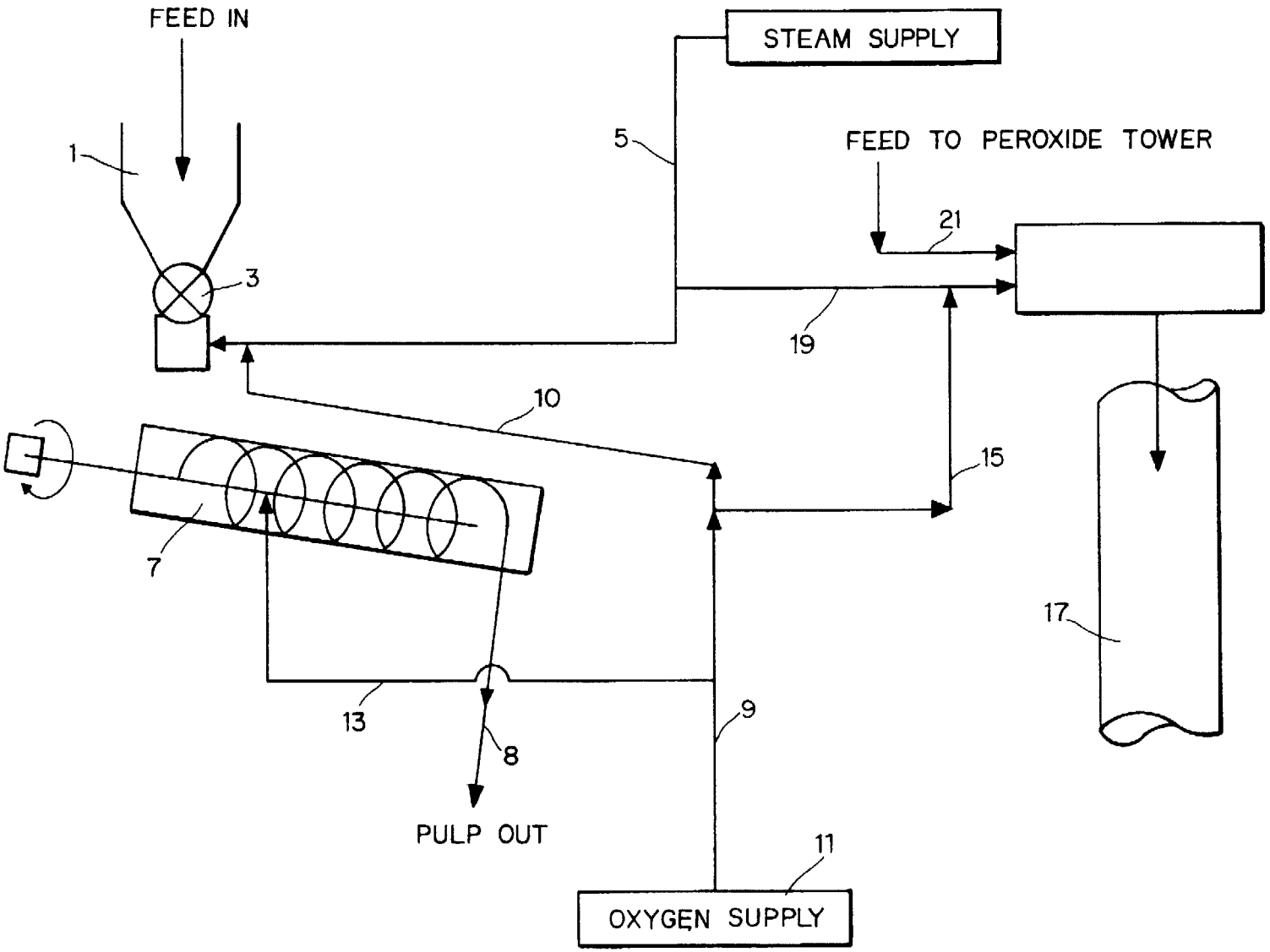
FIG. 1 provides a schematic diagram of a system made according to the present invention.

FIG. 1 shows, in schematic form, a pulp mill made according to the present invention. Raw materials, such as wood chips or cotton, enter the system through hopper 1. Valve 3 regulates the entry of the raw materials into the digester vessel 7. Steam supply line 5 delivers steam to the digester vessel. The steam enters the vessel at about the same point as the raw materials, as shown in FIG. 1. The digester is preferably of the type which has an internal screw drive which occupies most or part of the space inside the digester vessel. The screw drive moves the pulp along the digester vessel. However, the structure of the internal portion of the digester does not form part of the present invention, and the present invention should not be deemed limited by the specific construction of the digester.

It is preferred that the oxygen be injected into the steam line immediately before the point of entry of steam into the digester vessel. It is important to minimize the time spent by oxygen in mixing with the steam outside of the digester vessel, due to the reactivity of the oxygen and the high temperature of the steam.

Oxygen supply line 9 delivers oxygen from an oxygen supply 11. The oxygen supply line connects to oxygen conduit 10, which joins the steam supply line 5, also at about the same point where the raw materials enter the digester, as shown.

Oxygen supply line 9 is also connected to auxiliary oxygen line 13, which carries oxygen directly into the digester, without mixing with steam. Line 13 can be used in addition to, or instead of, oxygen conduit 10.

Oxygen supply line 9 also connects to oxygen conduit 15 which supplies oxygen to a bleaching unit including peroxide tower 17. Oxygen conduit 15 connects to steam conduit 19, which is fed by steam supply line 5. The feed to the peroxide tower enters through conduit 21. The feed to the peroxide tower could be, in a simple case, the output of earlier bleaching stages (not shown) which receive their input from the output 8 of the digester. The peroxide tower is one stage of the bleaching system. In practice, the bleaching process usually includes multiple stages (such as an additional treatment with caustic or oxygen, etc.), and these stages would normally be interposed between the output 8 of the digester and the input 21 to the peroxide tower.

The process of the present invention therefore comprises injecting oxygen into the steam line, immediately before the steam enters a digester vessel. An alternative process includes injecting oxygen directly into the digester vessel. Both of the above alternatives can be practiced simultaneously.

The alternative of injecting oxygen directly into the digester vessel, instead of into the steam line, is also advantageous, but not as much so as the case where the oxygen is injected with steam.

In the case of a kraft mill, it is preferred to add oxygen down-stream of the digester, such as at the exit port of the digester. It is also possible to add the oxygen inside the digester, immediately before the exit port. The reason for these alternatives is to prevent oxidation of sulfur in the digester, in processes where delignification requires the presence of unoxidized sulfur.

The process of the present invention may also include, as an additional optional step, injecting oxygen, with steam, at or near the point of entry of peroxide into a bleaching apparatus.

Figure 2:
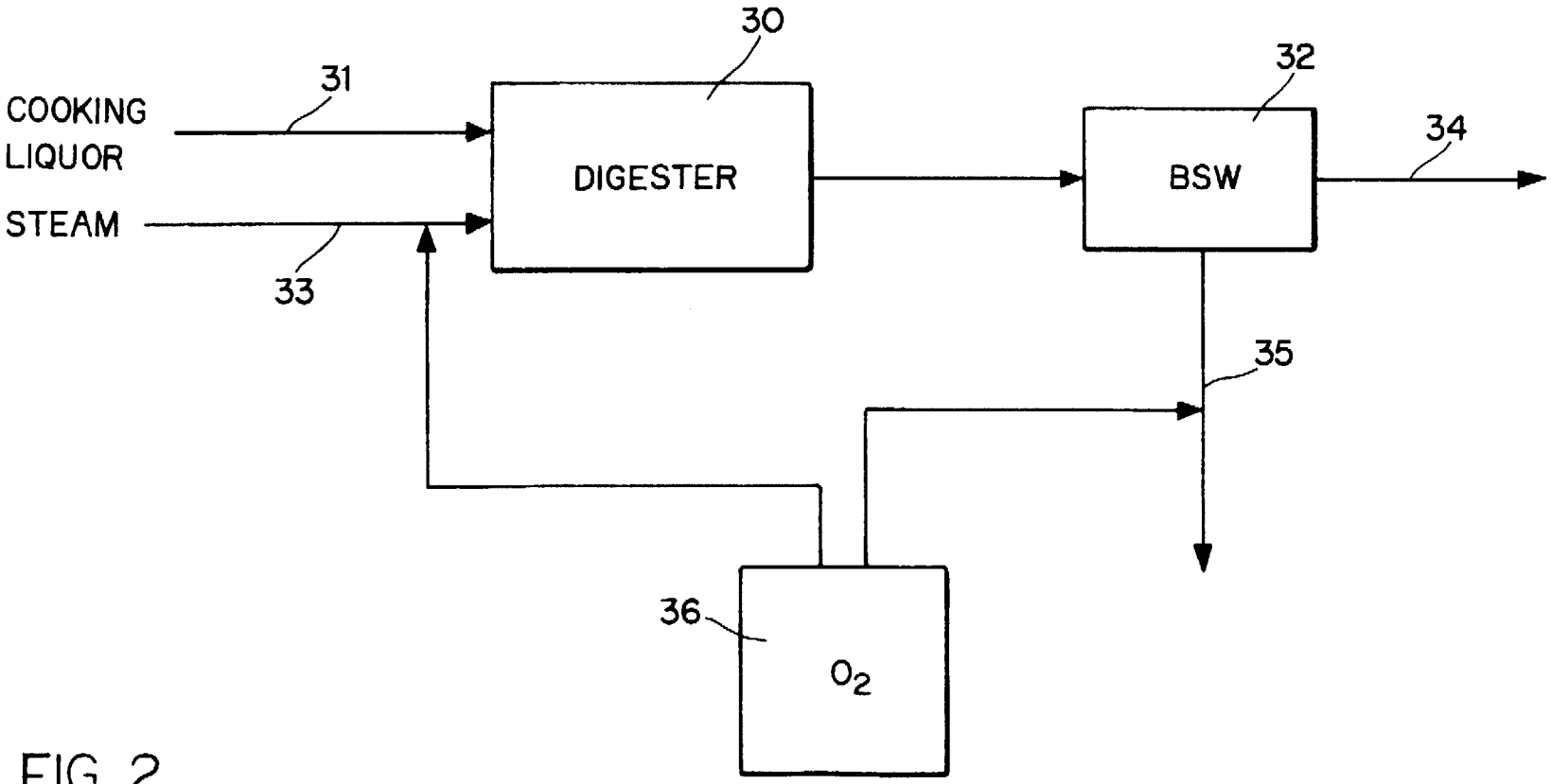
FIG. 2 provides a block diagram of an embodiment of the present invention wherein oxygen is used to treat the effluent from a brown stock washing stage.

FIG. 2 illustrates another variation of the present invention. Digester 30 receives cooking liquor, from line 31, and steam, from line 33. The output of the digester comprises pulp which enters brown stock washing unit 32. The output of unit 32, represented by output line 34, comprises the treated pulp. The brown stock washing unit includes effluent line 35. Oxygen source 36 supplies oxygen both to line 33, at the input end of the digester, and to effluent line 35. This embodiment has the advantage that the oxygen is also used to treat the effluent, thereby reducing the toxicity of the effluent.

The present invention has the following advantages. First, since the oxygen is injected with steam, the oxygen enters the digester at a high temperature, thereby increasing the reaction rate between the oxygen and the materials in the digester. Secondly, when the steam condenses onto the relatively cold pulp, it traps oxygen between the pulp and the surrounding condensed steam, forcing the oxygen to remain longer with the pulp, and therefore promoting more complete oxidation of the pulp. In effect, the mixture of the oxygen and steam, according to the present invention, enhances the effectiveness of the oxygen. In this way, the oxygen speeds the digesting process. It also reduces the amount of cooking liquor required to complete the digesting process, as the oxygen effectively performs some of the work otherwise performed by the cooking liquor.

The present invention also reduces the steam requirement for a given rate of production. And, in the case of a cellulose pulp mill, the invention has been found to help control the viscosity of the pulp in the digester.

The present invention also has the advantage that it can be used with either batch or continuous digester units. It has no moving mechanical parts, and therefore involves a relatively small capital investment to install. It can be easily incorporated into an existing pulp mill.

The invention can be modified in various ways, as will be apparent to the reader skilled in the art. The process of the present invention can be used with a wide range of operating temperatures and pressures. The flow rate of oxygen can be varied considerably, and the invention is not limited to any particular range. All of the foregoing parameters can be modified within the scope of the invention. These and other modifications should be considered within the spirit and scope of the following claims.

What is claimed is:

1. In a pulp mill, the pulp mill having a digester, the digester being connected to a source of raw material to be digested, the digester including a vessel which contains a digesting medium, the digester also being connected to a source of steam, the source of steam being connected to the digester at an inlet, the improvement comprising a source of oxygen, and a conduit extending from said source of oxygen to the inlet, wherein the conduit comprises means for introducing oxygen substantially simultaneously with steam, into the digester, the conduit comprising means for causing oxygen and steam to contact the raw material and the digesting medium while the raw material is being digested.

2. The improvement of claim 1, wherein the steam inlet is connected to said conduit at a point which minimizes exposure of oxygen to steam outside of the vessel.

3. The improvement of claim 1, further comprising a second conduit extending from the source of oxygen to the vessel, wherein the second conduit comprises means for introducing oxygen directly into the vessel.

4. In a method of operating a pulp mill, the method comprising the steps of mixing a raw material to be digested with a digesting medium, in a digester, and introducing steam into the digester at a steam inlet, the improvement comprising the step of introducing oxygen into the digester, at the steam inlet in a manner such that the oxygen and the steam contact the raw material and the digesting medium while the raw material is being digested.

5. The improvement of claim 4, wherein the oxygen introducing step is performed in a manner which minimizes exposure of oxygen to steam outside of the digester.

6. A pulp mill comprising:

a) a source of raw materials, b) a source of steam, the source of steam being connected to a steam conduit, c) a digester, the digester being connected to the source of raw materials and to the steam conduit, wherein raw materials and steam can enter the digester, and d) a source of oxygen, and an oxygen conduit connecting the source of oxygen to the steam conduit, such that oxygen can flow from the source into the steam conduit and into the digester, the conduit comprising means for causing the oxygen and the steam to contact the raw material and the digesting medium while the raw material is being digested.

7. The pulp mill of claim 6, wherein the oxygen conduit is connected to the steam conduit at a point which minimizes exposure of oxygen to steam outside the digester.

8. The pulp mill of claim 6, further comprising means for injecting oxygen directly into the digester.

9. A method of operating a pulp mill, the method comprising the steps of:

a) combining a raw material with a cooking liquor to form a mixture, b) introducing steam and oxygen into the mixture, wherein the steam and the oxygen are introduced in a manner such that the oxygen and the steam contact the raw material and the cooking liquor while the raw material is being digested, and c) maintaining the mixture in a steam and oxygen environment for a time sufficient to produce pulp.

10. The method of claim 9, wherein the oxygen and steam are introduced together into the mixture.

11. The method of claim 9, wherein the oxygen is introduced in a manner which minimizes exposure of the oxygen to the steam before the oxygen and steam contact the mixture.

12. The method of claim 9, wherein the oxygen and steam are introduced separately into the mixture.

13. A pulp mill comprising a digester, the digester being connected to a source of raw material to be digested, the digester including a vessel which contains a digesting medium, the digester also being connected to a source of steam, the source of steam being connected to the digester at an inlet, the pulp mill further comprising a source of oxygen, and a conduit extending from said source of oxygen to the inlet, wherein the conduit comprises means for introducing oxygen substantially simultaneously with steam, into the digester, the pulp mill further comprising a bleaching station, the bleaching station being connected to said source of steam, and further comprising an auxiliary conduit, from the source of oxygen, to the bleaching station.

14. A pulp mill comprising a digester, the digester being connected to a source of raw material to be digested, the digester including a vessel which contains a digesting medium, the digester also being connected to a source of steam, the source of steam being connected to the digester at an inlet, the pulp mill further comprising a source of oxygen, and a conduit extending from said source of oxygen to the inlet, wherein the conduit comprises means for introducing oxygen substantially simultaneously with steam, into the digester, wherein the digester is connected to a brown stock washing stage, the brown stock washing stage having an effluent line, and wherein the oxygen source is connected to said effluent line.

15. A method of operating a pulp mill, the method comprising the steps of mixing a raw material to be digested with a digesting medium, in a digester, introducing steam into the digester at a steam inlet, and introducing oxygen into the digester, at the steam inlet, the method further comprising the step of bleaching pulp produced in the digester, the bleaching step including the step of directing steam into a bleaching apparatus, the method further comprising the step of injecting oxygen into steam entering the bleaching apparatus.

16. The improvement of claim 15, wherein steam is injected into the bleaching apparatus at a point which minimizes exposure of oxygen to steam outside of the bleaching apparatus.

17. A method of operating a pulp mill, the method comprising the steps of mixing a raw material to be digested with a digesting medium, in a digester, introducing steam into the digester at a steam inlet, and introducing oxygen into the digester, at the steam inlet, wherein the digester is connected to a brown stock washing unit, the brown stock washing unit having an effluent line, and wherein the method further comprises the step of injecting oxygen into said effluent line.

18. A pulp mill comprising:

a) a source of raw materials, b) a source of steam, the source of steam being connected to a steam conduit, c) a digester, the digester being connected to the source of raw materials and to the steam conduit, wherein raw materials and steam can enter the digester, d) a source of oxygen, and an oxygen conduit connecting the source of oxygen to the steam conduit, such that oxygen can flow from the source into the steam conduit and into the digester, and e) bleaching apparatus, the bleaching apparatus connected to receive pulp produced by the digester, the bleaching apparatus also being connected to the source of steam through a second steam conduit, and means for introducing oxygen into the second steam conduit outside of the bleaching apparatus.

19. The pulp mill of claim 18, wherein the introducing means is connected to the second steam conduit at a point which minimizes exposure of oxygen to steam outside the bleaching apparatus.

20. A pulp mill comprising:

a) a source of raw materials, b) a source of steam, the source of steam being connected to a steam conduit, c) a digester, the digester being connected to the source of raw materials and to the steam conduit, wherein raw materials and steam can enter the digester, d) a source of oxygen, and an oxygen conduit connecting the source of oxygen to the steam conduit, such that oxygen can flow from the source into the steam conduit and into the digester, wherein the digester is connected to a brown stock washing unit, the brown stock washing unit having an effluent line, the source of oxygen also being connected to said effluent line.

21. A method of operating a pulp mill, the method comprising the steps of:

a) combining a raw material with a cooking liquor to form a mixture, b) introducing steam and oxygen into the mixture, c) maintaining the mixture in a steam and oxygen environment for a time sufficient to produce pulp, and d) washing the pulp to produce a treated pulp and an effluent, and injecting oxygen into a line containing said effluent.

* * * * *